US010544943B2

(12) United States Patent
Cimino et al.

(10) Patent No.: US 10,544,943 B2
(45) Date of Patent: Jan. 28, 2020

(54) DOMESTIC HOODS

(71) Applicant: ELICA S.P.A., Fabriano (IT)

(72) Inventors: Marco Cimino, Teramo (IT); Emanuele Spinaci, Fabriano (IT)

(73) Assignee: ELICA S.P.A., Fabriano (IT)

( * ) Notice: Subject to any disclaimer, the term of this patent is extended or adjusted under 35 U.S.C. 154(b) by 0 days.

(21) Appl. No.: 15/302,261

(22) PCT Filed: Mar. 26, 2015

(86) PCT No.: PCT/IB2015/052237
§ 371 (c)(1),
(2) Date: Oct. 6, 2016

(87) PCT Pub. No.: WO2015/155620
PCT Pub. Date: Oct. 15, 2015

(65) Prior Publication Data

US 2017/0023262 A1 Jan. 26, 2017

(30) Foreign Application Priority Data

Apr. 7, 2014 (IT) ..... MI2014A0638

(51) Int. Cl.
*F24C 15/20* (2006.01)
*F21V 23/06* (2006.01)
(Continued)

(52) U.S. Cl.
CPC ..... *F24C 15/2064* (2013.01); *F21V 21/096* (2013.01); *F21V 23/06* (2013.01); *F21Y 2115/10* (2016.08)

(58) Field of Classification Search
CPC ..... F24C 15/2064; F21V 21/096
(Continued)

(56) References Cited

U.S. PATENT DOCUMENTS 4,681,024 A 7/1987 Ivey
4,730,551 A 3/1988 Peludat
(Continued)

FOREIGN PATENT DOCUMENTS

DE 102009002503 A1 10/2010
EP 1 467 416 A2 10/2004
(Continued)

OTHER PUBLICATIONS

International Search Report dated Jun. 15, 2015, in corresponding PCT Application No. PCT/IB2015/052237, 4 pages.
(Continued)

*Primary Examiner* — Avinash A Savani
*Assistant Examiner* — Aaron H Heyamoto
(74) *Attorney, Agent, or Firm* — MH2 Technology Law Group LLP

(57) ABSTRACT

A domestic hood may include: a support frame with a power input; a motor fan unit located within the support frame; the support frame extends between a lower end portion and an upper end portion, and at the lower end portion, the hood has a suction port in fluid communication with the motor fan unit; filter means arranged between the suction port and the motor fan unit and configured to filter gases extracted by the motor fan unit through the suction port; lighting means including an enclosure that defines a seat containing a plate having a plurality of light-emitting diodes; fastener means for removably fixing the lighting means to the support frame; and/or electric connection means for electrically connecting the lighting means to the power input. The fastener means may include at least one magnetic element and at least one metal element.

20 Claims, 5 Drawing Sheets

(51) Int. Cl.
*F21V 21/096* (2006.01)
*F21Y 115/10* (2016.01)

(58) Field of Classification Search
USPC ..... 126/299 R
See application file for complete search history.

(56) References Cited

U.S. PATENT DOCUMENTS

| | | | | |
|---|---|---|---|---|
| 4,776,263 | A | 10/1988 | Lokander et al. | |
| 5,139,009 | A | 8/1992 | Walsh | |
| 5,865,674 | A | 2/1999 | Starr | |
| 5,934,362 | A | 8/1999 | Barker, II | |
| 5,938,527 | A | 8/1999 | Oshima et al. | |
| 6,030,287 | A | 2/2000 | Core | |
| 6,037,876 | A | 3/2000 | Crouch | |
| 6,222,459 | B1 | 4/2001 | Ting | |
| 6,274,375 | B1 | 8/2001 | McMinn, Jr. | |
| 6,454,834 | B1 | 9/2002 | Livingstone et al. | |
| 6,471,738 | B1 | 10/2002 | Thompson et al. | |
| 6,903,380 | B2 | 6/2005 | Barnett et al. | |
| 7,138,667 | B2 | 11/2006 | Barnett et al. | |
| 7,473,074 | B2 | 1/2009 | Herbst et al. | |
| 8,425,082 | B2 | 4/2013 | Wang | |
| 8,770,774 | B2 | 7/2014 | Ye et al. | |
| 9,194,603 | B2 | 11/2015 | Yuan et al. | |
| 9,416,989 | B1 | 8/2016 | Tom | |
| 9,553,451 | B2 | 1/2017 | Zacharchuk et al. | |
| 9,746,197 | B2 | 8/2017 | Katsumi et al. | |
| 9,816,717 | B1 | 11/2017 | Lawrence | |
| 2002/0155805 | A1 | 10/2002 | Paschke | |
| 2004/0201025 | A1 | 10/2004 | Barnett et al. | |
| 2005/0194607 | A1 | 9/2005 | Barnett et al. | |
| 2006/0160485 | A1 | 7/2006 | Brake et al. | |
| 2006/0278216 | A1 | 12/2006 | Gagas et al. | |
| 2008/0265789 | A1 | 10/2008 | Bertram et al. | |
| 2009/0061752 | A1 | 3/2009 | Burdett et al. | |
| 2009/0134812 | A1 | 5/2009 | Zhang | |
| 2009/0141506 | A1 | 6/2009 | Lan et al. | |
| 2009/0211564 | A1* | 8/2009 | Pan | F24C 15/2028 126/299 D |
| 2009/0316413 | A1 | 12/2009 | Henry | |
| 2010/0024106 | A1 | 2/2010 | Katsumi et al. | |
| 2010/0112929 | A1 | 5/2010 | Iantorno | |
| 2010/0136897 | A1* | 6/2010 | Lee | F24F 13/078 454/293 |
| 2012/0194069 | A1 | 8/2012 | Wang | |
| 2012/0319595 | A1 | 12/2012 | Antonopoulos et al. | |
| 2013/0043781 | A1* | 2/2013 | Wang | F21V 21/096 313/46 |
| 2013/0078902 | A1 | 3/2013 | Chung et al. | |
| 2014/0076367 | A1 | 3/2014 | Hung | |
| 2014/0083412 | A1 | 3/2014 | Chtchetinin | |
| 2014/0273803 | A1 | 9/2014 | Fontanesi | |
| 2014/0326145 | A1 | 11/2014 | McEvoy | |
| 2014/0331988 | A1 | 11/2014 | Milks et al. | |
| 2015/0056911 | A1 | 2/2015 | Brockman et al. | |
| 2015/0105013 | A1 | 4/2015 | Jeong et al. | |
| 2015/0168004 | A1 | 6/2015 | Emmons et al. | |

FOREIGN PATENT DOCUMENTS

| | | | | |
|---|---|---|---|---|
| EP | 1729068 | A1 | 12/2006 | |
| EP | 2 481 970 | A2 | 8/2012 | |
| EP | 2565534 | A1 | 3/2013 | |
| GB | 2426791 | A * | 12/2006 | F24C 15/2021 |
| WO | 2006077498 | A1 | 7/2006 | |

OTHER PUBLICATIONS

Written Opinion dated Jun. 15, 2015, in corresponding PCT Application No. PCT/IB2015/052237, 7 pages.
International Preliminary Report on Patentability dated Oct. 12, 2016, in corresponding PCT Application No. PCT/IB2015/052237, 8 pages.
International Search Report dated Jun. 15, 2015, in related PCT Application No. PCT/IB2015/052236, 4 pages.
Written Opinion dated Jun. 15, 2015, in related PCT Application No. PCT/IB2015/052236, 7 pages.
International Preliminary Report on Patentability dated Oct. 12, 2016, in related PCT Application No. PCT/IB2015/052236, 8 pages.
U.S. Office Action in related U.S. Appl. No. 15/302,264 dated Jun. 15, 2018, 19 pages.

* cited by examiner

DOMESTIC HOODS

CROSS-REFERENCE TO RELATED APPLICATION(S)

This application is a national stage entry from International Application No. PCT/IB2015/052237, filed on Mar. 26, 2015, in the Receiving Office ("RO/IB") of the International Bureau of the World Intellectual Property Organization ("WIPO"), and published as International Publication No. WO 2015/155620 A1 on Oct. 15, 2015; International Application No. PCT/IB2015/052237 claims priority from Italian Patent Application No. MI2014A000638, filed on Apr. 7, 2014, in the Italian Patent and Trademark Office ("IPTO"), the entire contents of all of which are incorporated herein by reference.

FIELD OF THE INVENTION

The present disclosure relates to a hood for domestic use as defined in the preamble of claim 1.

DISCUSSION OF THE RELATED ART

Domestic hoods are known, which may be either filter or extractor hoods, and have lighting members required for lighting the food preparation/cooking area.

For this purpose, the lighting members have a frame that may be possibly equipped with a shield having one or more lighting devices there behind, such as incandescent, neon or LED lamps.

These lighting members are powered by appropriate electric connection means, which are designed to electrically connect the lighting devices to the input section of a power circuit, which is held within the hood frame.

Particularly, these lighting devices are in such arrangement that the light beam emitted thereby can illuminate the cooktop area.

Due to their position, these lighting devices are impinged upon by the gas flow extracted by the motor fan unit located within the hood frame and the gases are filtered by a filter unit located downstream from said lighting means.

Due to their nature, gases tend to deposit a layer of grease on the screen, if any, thereby reducing the lighting capacity.

Thus, the user is required to clean the lighting members and the filter unit.

For this purpose, in such domestic hoods both the lighting means and the filter unit are designed to be removable from the hood frame.

PRIOR ART PROBLEM

The removal of the filter unit requires the lighting means to be removed first. This is not always easy and safe for the user because the removal of the lighting means always requires the user to directly act, by his/her hands or using special tools, on the electric connection means, even though they have a low voltage, e.g. 24 Volt.

EP 1729068 discloses a wall-mounted combination extractor fan and light unit. Particularly, the user can only access the motor within its enclosure by first removing the lamp shields, then unscrewing the lamp from its support and removing the support from the enclosure, as the shield, the lamp and the support are individually movable elements that cannot be removed as an assembly. Therefore, EP 1729068 does not disclose a one-step removal of the assembly composed of the shield, the lamp and the support with simultaneous electric disconnection, with the user not being required to perform additional steps.

SUMMARY OF THE INVENTION

The above described prior art clearly shows that a need is strongly felt by hood manufacturers for simple and quicker removal of the lighting means by the user, without the need of electrically disconnecting such lighting means from the power source, by hand or using tools.

Advantages of the Invention

According to the present invention, this object is fulfilled by a hood as defined in claim 1.

With the present invention, the lighting means can be removed from the hood frame by exerting such a pull force as to release the electric connection with the input section of the power circuit. Thus, the lighting means can be directly and electrically insulated upon removal thereof.

Furthermore, with the present invention, the user may remove the lighting means without having to act upon the electric connections.

BRIEF DESCRIPTION OF THE DRAWINGS

The characteristics and advantages of the present disclosure will appear from the following detailed description of a possible practical embodiment, illustrated as a non-limiting example in the set of drawings, in which.

DETAILED DESCRIPTION

Figure 1:
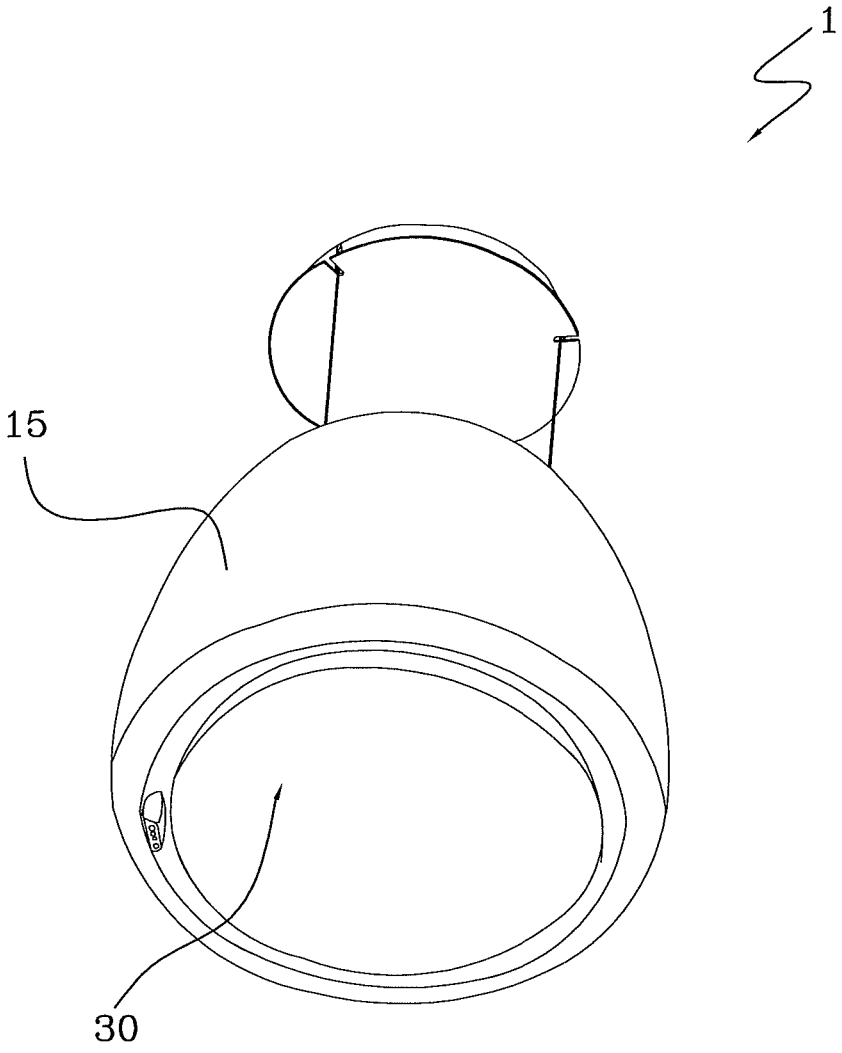
FIG. 1 shows a perspective view of a domestic of the present invention.

Referring to the accompanying figures, numeral 1 designates a hood for domestic use.

The hood 1 extends along a main longitudinal direction X-X and comprises a support frame 10, a motor fan unit 20 located within the frame 10 and supported thereby, as well as lighting means 30.

The support frame 10 extends between a lower end portion 2 and an upper end portion 3.

At the lower end portion 2, the hood 1 has a suction port 4 in fluid communication with the motor fan unit 20.

Filter means 50 are arranged between the suction port 4 and the motor fan unit 20, and are configured to filter the gases extracted by the motor fan unit 20 through the suction port 4.

The hood 1 also comprises a protective enclosure 15 which is disposed outside the support frame 19 to enclose the support frame 10, the motor fan unit 20 and the filter means 50.

At the upper end portion 3, the hood 1 has an exhaust port 5 in fluid communication with the motor fan unit 20.

The frame 10 has a power input 11 through which the hood 1 may be connected to the mains, to supply power to the motor fan unit 20 and the lighting means 30.

In the example of the annexed figures, the power input 11 is located at the upper end 3.

The input 11 is connected via respective power lines to the power input (not shown) of the motor fan unit 20 and, via means to be later described in detail, to the lighting means 30.

The lighting means 30 are removably fixed to the support frame 10 and are movable relative to the support frame 10, preferably in the longitudinal direction X-X. For this purpose, the hood 1 comprises fixing means 40 for removably fixing the lighting means 30 to the support frame 10.

The hood 1 further comprises electric connection means 60 for electrically connecting the lighting means 30 to the power input 11.

The lighting means 30 are movable relative to the support frame 10 between a first position (see FIG. 4) in which the electric connection means 60 electrically connect the lighting means 30 to the power input 11, and a second position (see FIG. 5) in which the lighting means 30 are electrically disconnected from the power input 11, i.e. with no additional step.

Particularly, the electric connection means 60 are configured to electrically disconnect the lighting means 30 from the power input 30 directly, once the lighting means 30 have moved from the first position to the second position. This will afford electric insulation of the lighting means 30 as soon as the lighting means 30 are removed for access to the interior of the support frame 10, e.g. for replacing the filter means. Such electric insulation of the lighting means 30 allows the user to access the filter means 50 without risking any contact with live elements.

According to one embodiment, the filter means 50 are housed in a filter holder 51 which is removably fixed to the support frame 10. Advantageously, the filter holder 51 is removably fixed to the support frame 10 by magnetic coupling. For example, the support frame 10 may be equipped with one or more magnetic elements 52 which hold a metal element 53 embedded in the filter holder 51 or stably fixed thereto.

According to one embodiment, the electric connection means 60 include first contact means 61 arranged on the frame 10 and rigidly joined thereto and second contact means 62 arranged on the lighting means 30 and rigidly joined thereto. Therefore, as said second contact means 62 move from the first position to the second position, they move with said lighting means 30.

In the first position, the first contact means 61 contact the second contact means 62 to electrically connect the lighting means 30 to the power input 11, whereas in the second position the second contact means 62 are electrically disconnected from the first contact means 61 to electrically insulate the lighting means 30.

The first contact means 61 are connected via a power line (not shown) to the power input 11.

In this example, the power line is placed in a cable guide 13 which is rigidly joined to the support frame 10.

In one embodiment, the first contact means 61 comprise at least one male terminal, in this example a single male terminal which preferably extends in the longitudinal direction X-X. This will facilitate the movement of the lighting means 30 in this longitudinal direction X-X from the first position to the second position and vice versa.

Figure 4:
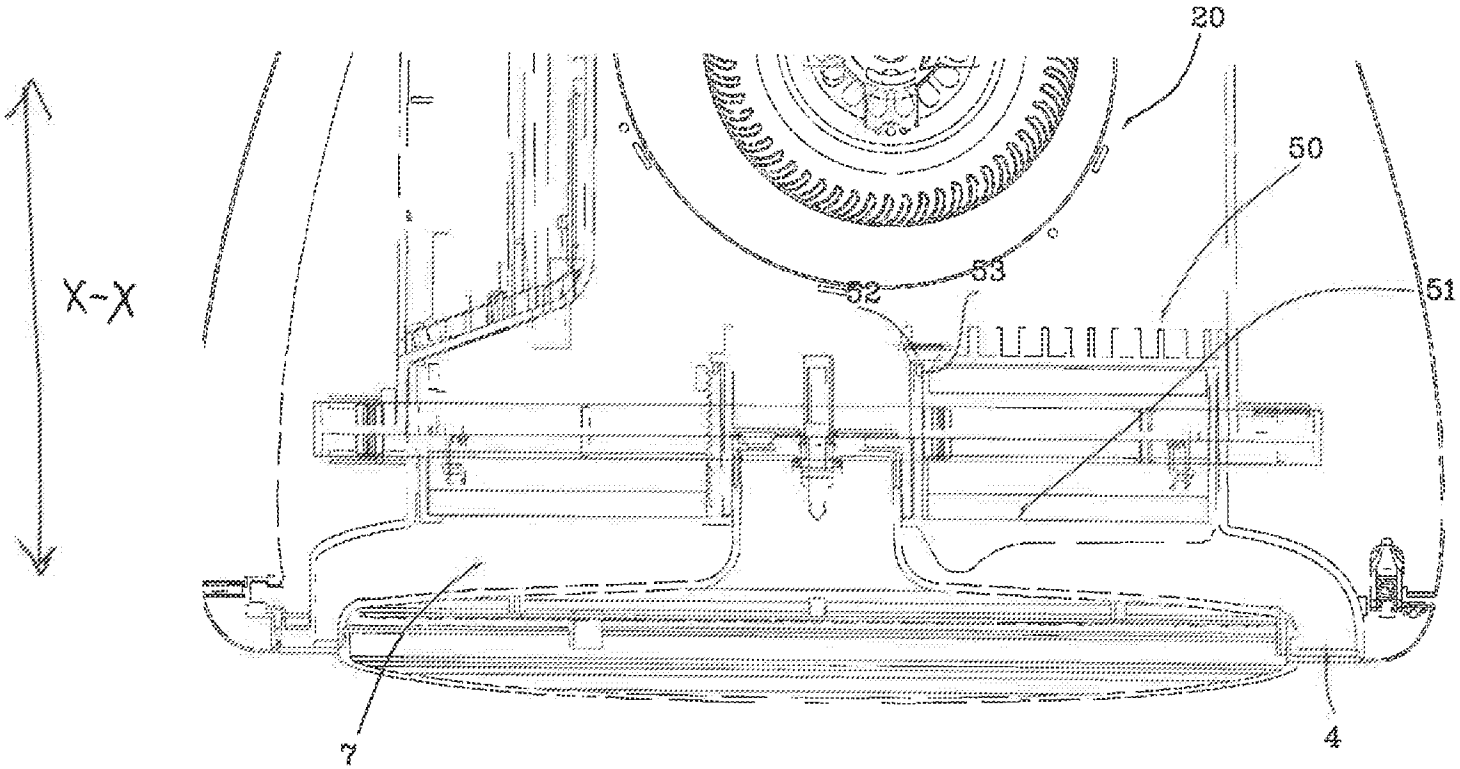
FIG. 4 shows a sectional view of the lighting means associated with the hood frame of the present invention.
Figure 5:
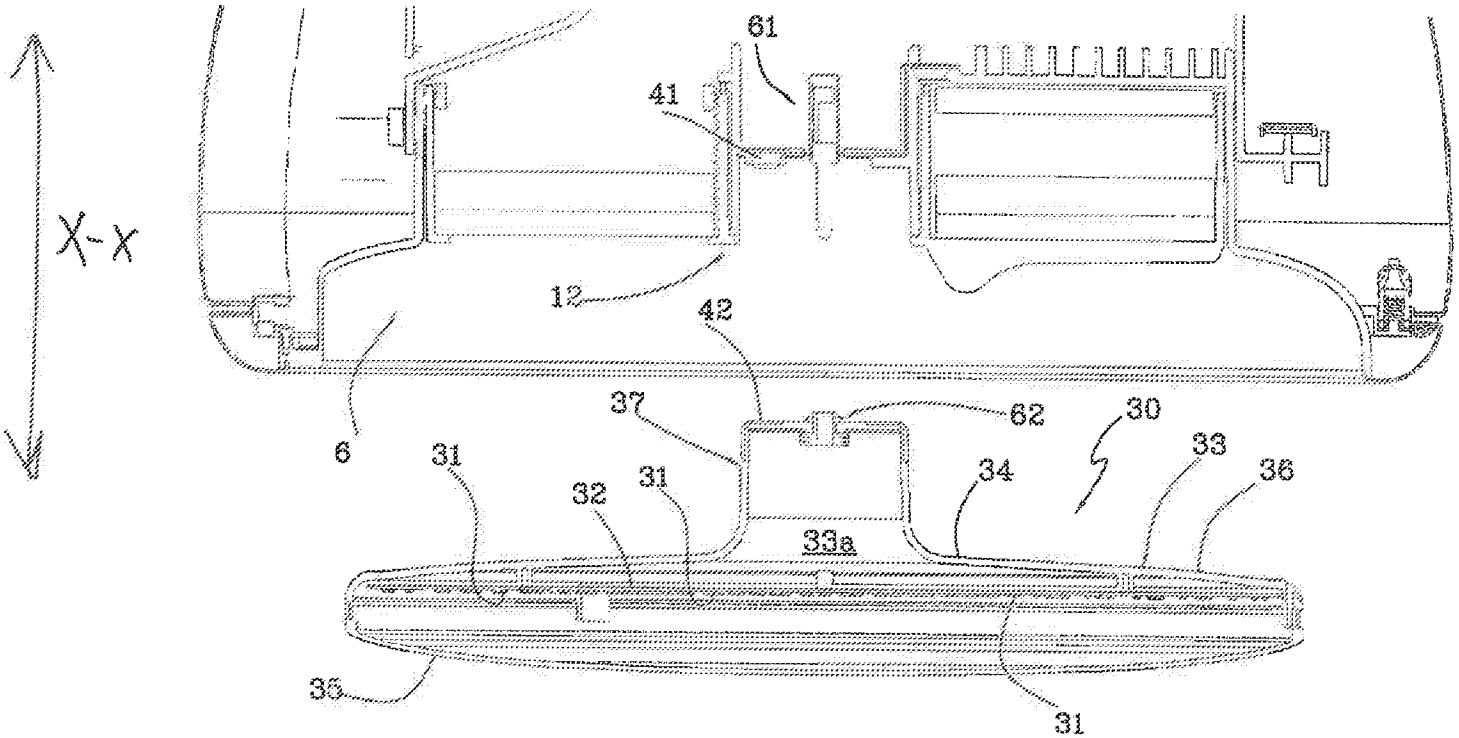
FIG. 5 shows a sectional view of the lighting means removed from the hood frame of the present invention.

The second contact means 62 comprise at least one female terminal, in this example a single female terminal, which is configured to receive and be coupled with a respective male terminal 61 (see FIGS. 4 and 5).

Figure 2:
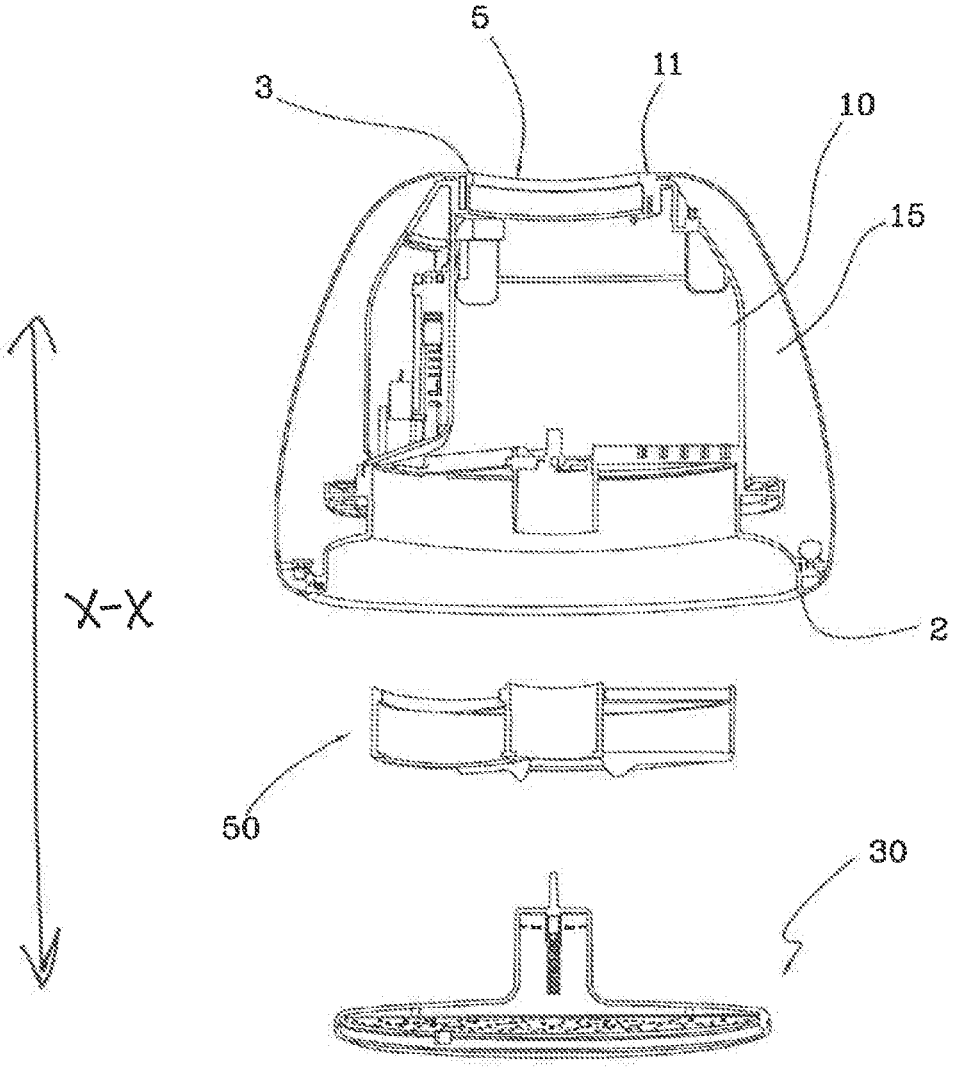
FIG. 2 shows a partially sectional side view of the hood of FIG. 1.
Figure 3:
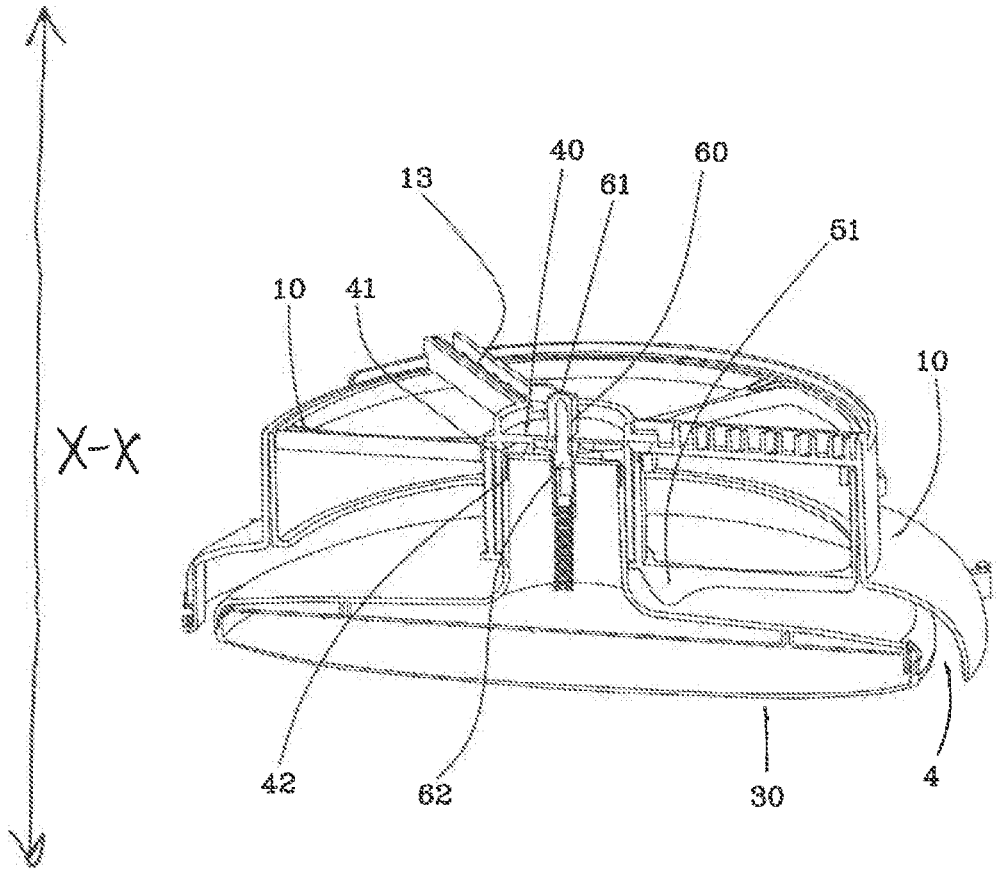
FIG. 3 shows a partially sectional perspective view of the lighting means of the present invention.

Alternatively, the first contact means 61 comprise a female terminal and the second contact means 62 comprise a male terminal (see FIGS. 2 and 3).

In one embodiment, the lighting means 30 are situated at the lower end portion 2 of the frame 10, hence upstream from the filter means 50. In order to accommodate the lighting means 30, the frame 10 has a seat 6 at the lower end portion 2. This seat 6 is designed to receive the lighting means 30 such that, in the first position—corresponding to the operating position—the lighting means 30 form a gap with the perimeter portion of the seat 6.

This gap defines the suction port 4 and allows the user to easily remove the lighting means 30. This is because, due to this gap, the user can access the lateral portion of the lighting means 30 and manually take hold of the lighting means 30 to move them from the first position to the second position.

In one embodiment, the lighting means 30 comprise an enclosure 33 that defines a seat **33*a* containing a plate 32 having a plurality of LEDs 31**.

Nevertheless, in FIGS. 4 and 5 the enclosure 33 that defines the seat **33*a* containing the plate 32 having the plurality of LEDs 31 is itself movable relative to the support frame 10 between the first position (FIG. 4) and the second position (FIG. 5), in which the LEDs 31 are electrically disconnected from the power input 11**.

The LEDs 31 are connected to the second contact means 62.

The enclosure 33 has an upper portion 34 and a lower portion 35.

The second contact means 62 are located in the upper portion 34 and are connected to the LEDs 31. Particularly, the upper portion 34 has an annular part 36 and a central part 37 that projects from the plane of the annular part 36 along the longitudinal direction X-X. The second contact means 62 are located at the upper portion of the central part 37. In this embodiment, the first contact means 61 are arranged in a central part 12 of the support frame 10, which is configured to face the central part 37 of the lighting means 30 in the first position.

Advantageously, the lower portion 33 and the upper portion 34 are removably attached to each other, in this example, by clip-on fastening members, for the LEDs 31 to be accessed and replaced in case of failure.

The lower portion 33 may be transparent or opaque, according to the desired illumination intensity.

In order to allow air to flow from the suction port 4 to the motor fan unit 20, the upper portion 34 of the lighting means 30 is spaced from the filter means 50 to thereby define an annular channel 7 (which is known as perimeter extraction) providing fluid communication between the gap 4, i.e. the suction port of the hood 1 and the filter means 50. This annular channel 7 also assists the user in taking hold of the lighting means 30 when the latter are in the first position, by allowing him/her to insert the end portions of his/her fingers both in the gap 4 and in the annular channel 6 above it.

The fixing means 40 are also movable between a first position, in which they hold the lighting means 30 attached to the support frame 10 and a second position, in which the lighting means 30 are disengaged from the support frame 10.

In one embodiment, the electric connection means 60 may be configured to also act as fixing means 40. In this case, the first and second positions of the fixing means 40 correspond to the first and second positions of the electric connection means 60 respectively. Therefore, the lighting means 30 are disengaged from the support frame 10 and electrically disconnected from the power input 11 substantially at the same time.

Nevertheless, advantages are derived from using the embodiment in which the electric connection means 60 are distinct from the fixing means 40 and define respective second positions, whereby the lighting means 30 are disengaged from the support frame 10 and are electrically disconnected from the power input 11 at distinct times during removal of the lighting means from the hood 1.

In one embodiment, the fixing means 40 comprise at least one magnetic element 41 and at least one metal element 42, which are located on said support frame 10 and said lighting means 30 respectively, or vice versa, In the first position, the magnetic element 41 holds the metal element 42 to keep the lighting means 30 attached to the support frame 10.

In a second position of the fixing means 40, the metal element 42 disengages from the magnetic element 41. Thus, the metal element 42 disengages from the magnetic element 41 as the lighting means move from the first position to the second position.

In this example, the fixing means 40 comprise three magnetic elements 41 arranged on the support frame 10, at an angular distance of 120° from each other.

The metal element 42 is embedded in the enclosure 33 of the lighting means 30, particularly in its central part 37. Alternatively, the metal element 42 may be stably attached to the enclosure 33.

Due to the use of magnetic elements, the lighting means 30 move toward the second position, a magnetic gap is formed between the magnetic elements 41 and the metal element 42. The formation of such magnetic gap allows the lighting means 30 to be disengaged from the support frame 10 but still electrically connected to the power input 11 via the electric connection means 60. This electric connection is broken when the lighting means 30 are in the second position.

Those skilled in the art will obviously appreciate that a number of changes and variants may be made to the above described hood, to fulfill particular requirements, without departure from the scope of the invention, as defined in the following claims.

The invention claimed is:

1. A domestic hood, comprising:

a support frame with a power input;

a motor fan unit located within said support frame;

said support frame extends along a main longitudinal direction between a lower end portion and an upper end portion, and at said lower end portion, the hood has a suction port in fluid communication with the motor fan unit;

filter means arranged along the main longitudinal direction between the suction port and said motor fan unit and configured to filter gases extracted by the motor fan unit through the suction port;

lighting means comprising an enclosure that defines a seat containing a plate having a plurality of light-emitting diodes (LEDs);

fastener means for removably fixing said lighting means to said support frame; and electric connection means for electrically connecting said lighting means to said power input;

wherein said fastener means comprises at least one magnetic element and at least one metal element, which are placed on said support frame and said lighting means respectively, or vice versa, wherein said lighting means is located at the suction port when the lighting means is electrically connected to the power input, wherein said lighting means is movable relative to said support frame along the main longitudinal direction between a first position, in which said electric connection means electrically connect said lighting means to said power input, and a second position, in which said lighting means is electrically disconnected from said power input so as to provide access to an interior of said support frame for replacing said filter means, wherein the suction port directly faces an outside environment and lies in a plane perpendicular to the main longitudinal direction, wherein the suction port is configured to convey a flow of the gases extracted by the motor fan unit along a flow direction parallel to the main longitudinal direction, wherein in the first position, the suction port substantially surrounds the lighting means, and wherein said electric connection means is configured to electrically disconnect said lighting means from said power input without any intermediate step, once said lighting means has moved from said first position to said second position.

2. The domestic hood as claimed in claim 1, wherein:

in said first position, said at least one magnetic element holds said at least one metal element to keep said lighting means attached to said support frame, and in said second position, said at least one metal element is released from said at least one magnetic element.

3. The domestic hood as claimed in claim 1, wherein said at least one metal element disengages from said at least one magnetic element as said lighting means moves from said first position to said second position.

4. The domestic hood as claimed in claim 1, wherein:

said electric connection means comprises first contact means arranged on said support frame and second contact means arranged on said lighting means, as said second contact means moves from the first position to the second position, the second contact means moves with said lighting means, in said first position, said first contact means contacts said second contact means to electrically connect said lighting means to said power input, and in the second position, said second contact means is electrically disconnected from said first contact means to electrically insulate said lighting means.

5. The domestic hood as claimed in claim 4, wherein:

said first contact means comprises at least one male terminal, and said second contact means comprises at least one female terminal, said at least one female terminal being configured to receive and be coupled with a respective male terminal of the first contact means.

6. The domestic hood as claimed in claim 4, wherein:

said first contact means comprises at least one female terminal, and said second contact means comprises at least one male terminal, said at least one male terminal being configured to be coupled with a respective female terminal of the first contact means.

7. A domestic hood, comprising:

a support frame having a power input;

a motor fan unit within the support frame;

filter means configured to filter gases extracted by the motor fan unit;

lighting means that comprises a plurality of light-emitting diodes (LEDs);

fastener means for removably fixing the lighting means to the support frame; and electric connection means for electrically connecting the lighting means to the power input;

wherein the support frame extends along a main longitudinal direction between a lower end portion of the support frame and an upper end portion of the support frame, wherein the domestic hood comprises a suction port, at the lower end portion of the support frame, the suction port directly facing an outside environment and being in fluid communication with the motor fan unit, the suction port being configured to convey a flow of the gases extracted by the motor fan unit along a flow direction parallel to the main longitudinal direction, wherein the motor fan unit is configured to extract the gases through the suction port, then through the filter means, and then through the motor fan unit, the suction port, the filter means, and the motor fan unit being arranged sequentially along the main longitudinal direction, wherein the fastener means comprises at least one magnetic element on the support frame and at least one metal element on the lighting means, or at least one magnetic element on the lighting means and at least one metal element on the support frame, wherein the lighting means is slidably movable relative to the support frame along a direction parallel to the flow direction between a first position, in which the lighting means directly faces the outside environment and the electric connection means electrically connects the lighting means to the power input, and a second position, in which the lighting means is electrically disconnected from the power input so as to provide access to an interior of the support frame for replacing the filter means, wherein in the first position, the lighting means is at the lower end portion of the support frame, upstream from the filter means, wherein the suction port comprises a ring opening defined by an inner perimeter of the support frame and by an outer perimeter of the lighting means, and wherein when the lighting means moves from the first position to the second position, the electrical connection means electrically disconnects the lighting means from the power input without any intermediate step.

8. The domestic hood of claim 7, wherein in the first position, the at least one magnetic element holds the at least one metal element to keep the lighting means attached to the support frame, and wherein in the second position, the at least one metal element is released from the at least one magnetic element.

9. The domestic hood of claim 7, wherein the at least one metal element disengages from the at least one magnetic element as the lighting means moves from the first position to the second position.

10. The domestic hood of claim 7, wherein the electric connection means comprises first contact means arranged on the support frame and second contact means arranged on the lighting means, and wherein as the second contact means moves from the first position to the second position, the second contact means moves with the lighting means.

11. The domestic hood of claim 10, wherein in the first position, the first contact means contacts the second contact means to electrically connect the lighting means to the power input, and wherein in the second position, the second contact means is electrically disconnected from the first contact means to electrically insulate the lighting means.

12. The domestic hood of claim 10, wherein the first contact means comprises at least one male terminal, wherein the second contact means comprises at least one female terminal, and wherein the at least one female terminal is configured to couple with a respective male terminal of the first contact means.

13. The domestic hood of claim 10, wherein the first contact means comprises at least one female terminal, wherein the second contact means comprises at least one male terminal, and wherein the at least one male terminal is configured to couple with a respective female terminal of the first contact means.

14. A domestic hood, comprising:

a support frame having a power input;

a motor fan unit within the support frame;

filter means configured to filter gases extracted by the motor fan unit;

lighting means that comprises a plurality of light-emitting diodes (LEDs);

fastener means for removably fixing the lighting means to the support frame; and electric connection means for electrically connecting the lighting means to the power input;

wherein the support frame extends along a main longitudinal direction between a lower end portion of the support frame and an upper end portion of the support frame, wherein the domestic hood comprises a suction port, between the lighting means and the lower end portion of the support frame, in fluid communication with the motor fan unit, wherein the suction port is configured to convey a flow of the gases along a flow direction parallel to the main longitudinal direction, wherein the motor fan unit is configured to extract the gases through the suction port, then through the filter means, and then through the motor fan unit, wherein the fastener means comprises at least one magnetic element on the support frame and at least one metal element on the lighting means, or at least one magnetic element on the lighting means and at least one metal element on the support frame, wherein the lighting means is movable relative to the support frame along the main longitudinal direction between a first position, in which the electric connection means electrically connects the lighting means to the power input, and a second position, in which the lighting means is electrically disconnected from the power input so as to provide access to an interior of the support frame for replacing the filter means, wherein in the first position, the lighting means partially defines the suction port, wherein the suction port is enclosed between the support frame and the lighting means, and wherein when the lighting means moves from the first position to the second position, the electrical connection means electrically disconnects the lighting means from the power input without any intermediate step.

15. The domestic hood of claim 14, wherein in the first position, the at least one magnetic element holds the at least one metal element to keep the lighting means attached to the support frame, and wherein in the second position, the at least one metal element is released from the at least one magnetic element.

16. The domestic hood of claim 14, wherein the at least one metal element disengages from the at least one magnetic element as the lighting means moves from the first position to the second position.

17. The domestic hood of claim 14, wherein the electric connection means comprises first contact means arranged on the support frame and second contact means arranged on the lighting means, and wherein as the second contact means moves from the first position to the second position, the second contact means moves with the lighting means.

18. The domestic hood of claim 17, wherein in the first position, the first contact means contacts the second contact means to electrically connect the lighting means to the power input, and wherein in the second position, the second contact means is electrically disconnected from the first contact means to electrically insulate the lighting means.

19. The domestic hood of claim 17, wherein the first contact means comprises at least one male terminal, wherein the second contact means comprises at least one female terminal, and wherein the at least one female terminal is configured to couple with a respective male terminal of the first contact means.

20. The domestic hood of claim 17, wherein the first contact means comprises at least one female terminal, wherein the second contact means comprises at least one male terminal, and wherein the at least one male terminal is configured to couple with a respective female terminal of the first contact means.

* * * * *